United States Patent [19]

Beehler et al.

[11] Patent Number: 5,000,594

[45] Date of Patent: Mar. 19, 1991

[54] PRINTER WITH CARRIAGE-ACTUATED CLUTCH AND PAPER-FEED MECHANISM

[75] Inventors: James O. Beehler, Brush Prairie; Allan G. Olsen, Camas; Chong S. Yoon, Vancouver, all of Wash.

[73] Assignee: Hewlett-Packard Company, Palo Alto, Calif.

[21] Appl. No.: 421,454

[22] Filed: Oct. 13, 1989

[51] Int. Cl.[5] ..... B41J 19/94

[52] U.S. Cl. ..... 400/569; 400/568; 400/624; 400/314; 400/315

[58] Field of Search ..... 400/624, 568, 578, 569, 400/313, 314, 314.1, 314.6, 315; 192/20, 67 R, 314.2, 305, 306.2, 319, 320.1, 321

[56] References Cited

U.S. PATENT DOCUMENTS 4,667,947 5/1987 Costa et al. ..... 400/624

OTHER PUBLICATIONS

IBM Tech. Disclosure Bulletin vol. 30, No. 3, Aug. 1987.

IBM Tech. Disclosure Buttetin vol. 24, No. 10, Mar. 1982.

*Primary Examiner*—Edgar S. Burr

*Assistant Examiner*—Ren Yan

[57] ABSTRACT

The invented printer includes a carriage-actuated clutch and a motor-driven gear element. The clutch is selectively engageable with the element and causes the printer to perform different tasks when engaged. More specifically, the invented printer includes a motor-driven gear, a printhead and a printhead carriage, a clutch having a flexible portion, and a gripping surface on the flexible portion for engaging the motor-driven gear. To actuate the clutch, the carriage pushes against the clutch causing it to flex and engage the motor-driven gear. When engaged, rotating the gear a predetermined distance causes the clutch to rotate a predetermined distance, in turn causing the printer to perform a certain task. Continuing to rotate the clutch causes the printer to perform other tasks.

The invented printer also includes a paper-feed mechanism for picking up and feeding a sheet of paper into the printer. This mechanism incudes a rotatable drive roller that moves paper through the printer, a spring-biased plate capable of pivoting around an axial pivot, biased to extend toward the drive roller and on which paper is tacked, a partition, having at least one opening, positioned between the roller and the plate for generally preventing the roller from contacting the media on the plate, and a pivot adjacent the roller for selectively allowing at least a part of the roller to extend through the opening in the partition to contact the top sheet of paper and feed it through the printer. The paper-feed mechanism is one task that may be triggered by the carriage-actuated clutch.

8 Claims, 6 Drawing Sheets

PRINTER WITH CARRIAGE-ACTUATED CLUTCH AND PAPER-FEED MECHANISM

TECHNICAL FIELD

This invention relates to a printer with a carriage-actuated clutch and a paper-feed mechanism. More particularly, this invention relates to a printer capable of performing different tasks, one of which is feeding paper into the printer, wherein the tasks are triggered by a carriage-actuated clutch.

BACKGROUND ART

In order for printers to operate effectively, they must be able to perform different tasks during a print cycle, such as picking up a sheet of paper, feeding it into the printer and expelling it after printing. To perform such tasks, printers generally have different motor-driven gear trains. For example, to pick up a sheet of paper, a printer may have one gear train that, when engaged, triggers a mechanism that can pick up the next sheet of paper. The printer would have another gear train to eject the sheet of paper after printing. Accordingly, printers generally include numerous gears and different gear trains.

Additionally, a printer may include a multiplexer to engage different gear trains. For example, the printer described in U.S. Pat. No. 4,728,963, naming Steve O. Rasmussen et al. as inventors, includes a multiplexer. In that printer, the multiplexer has three multiplexer gears. A different multiplexer gear is required for each different task that the printer can perform. Each multiplexer gear is engaged by moving a trigger. Different printer tasks are actuated by engaging different multiplexer gears.

A problem with printers having multiplexer gears and multiple gear trains is that numerous, complex and costly gear mechansims are required. This invention offers a printer capable of performing different tasks without requiring complex gear trains and multiplexer gears. In other words, the invented printer includes a carriage-actuated clutch that may be used to trigger different tasks. Thus, the invented printer may be manufactured much less expensively and with fewer parts than existing printers.

As stated, one task that a printer must perform is to pick a sheet of paper and feed it into the printer. To accomplish this a printer must have a paper-feed mechanism. One type of paper-feed mechanism, as described in U.S. Pat. No. 4,728,963, includes a spring-biased plate that articulates between raised and lowered positions. Paper is stacked on the plate and when a certain gear train is engaged, the plate is allowed to articulate to its raised position. In its raised position, drive rollers contact the top sheet on the stack and feed it into the printer. Thereafter, the gear train causes the plate to articulate to its lowered position. As stated, such a paper-feed mechanism may be triggered by a multiplexer and requires a separate multiplexer gear and a complex and costly gear train.

The invented printer includes a paper-feed mechanism that can be triggered by the same carriage-actuated clutch that may be used to trigger other functions. Additionally, the paper-feed mechanism of the invented printer does not require a gear train that causes the plate to articulate between raised and lowered positions. Thus, the invented printer includes a simpler and more economical paper-feed mechanism than is present in existing printers.

DISCLOSURE OF THE INVENTION

The invented printer includes a carriage-actuated clutch and a motor-driven gear element. The clutch is selectively engageable with the element and causes the printer to perform different tasks when engaged. More specifically, the invented printer includes a motor-driven gear, a printhead and a printhead carriage, a clutch having a flexible portion, and a gripping surface on the flexible portion for engaging the motor-driven gear. To actuate the clutch, the carriage pushes against the clutch causing it to flex and engage the motor-driven gear. When engaged, rotating the gear a predetermined distance causes the clutch to rotate a predetermined distance, in turn causing the printer to perform a certain task. Continuing to rotate the clutch causes the printer to perform other tasks.

The invented printer also includes a paper-feed mechanism for picking up and feeding a sheet of paper into the printer. The paper-feed mechanism includes a rotatable drive roller that moves paper through the printer, a spring-biased plate capable of pivoting around an axial pivot, biased to extend toward the driver roller and on which paper is stacked, a partition, having at least one aperture, positioned between the roller and the plate for generally preventing the roller from contacting the media on the plate, and a pivot adjacent the roller for selectively allowing at least a part of the roller to extend through the opening in the partition to contact the top sheet of paper and feed it through the printer. The paper-feed mechanism is one task that may be triggered by the carriage-actuated clutch.

DETAILED DESCRIPTION AND BEST MODE FOR CARRYING OUT THE INVENTION

Figure 1:
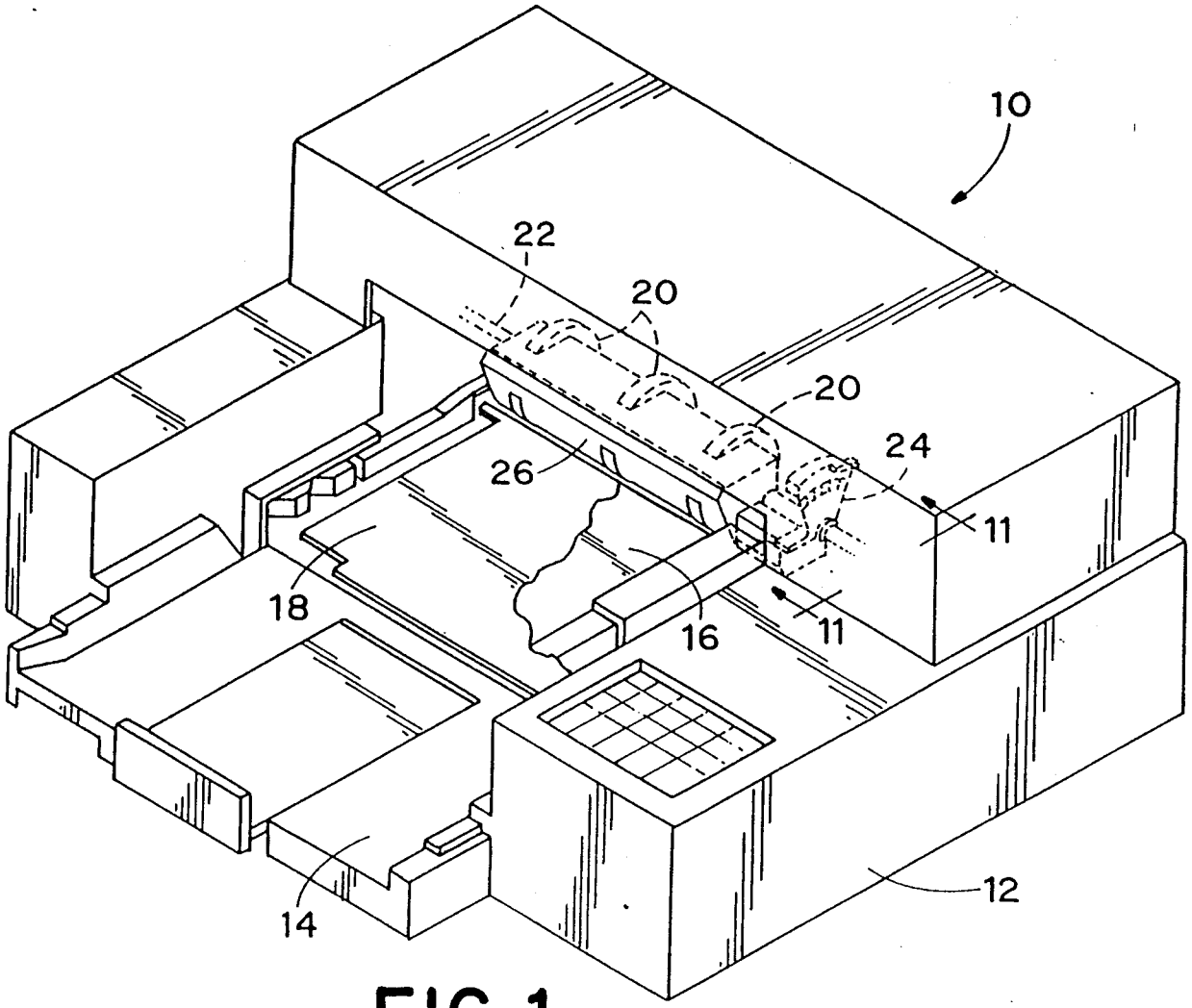
FIG. 1 is a perspective view of a printer employing a carriage-actuated clutch constructed according to the invention.
Figure 2:
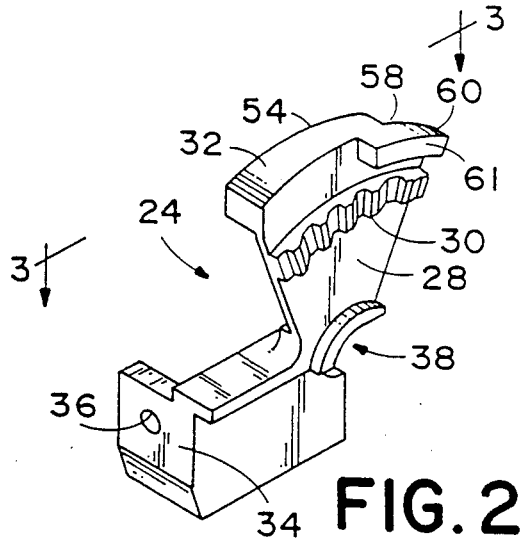
FIG. 2 is an enlarged perspective view of the clutch employed in the printer of FIG. 1.
Figure 3:
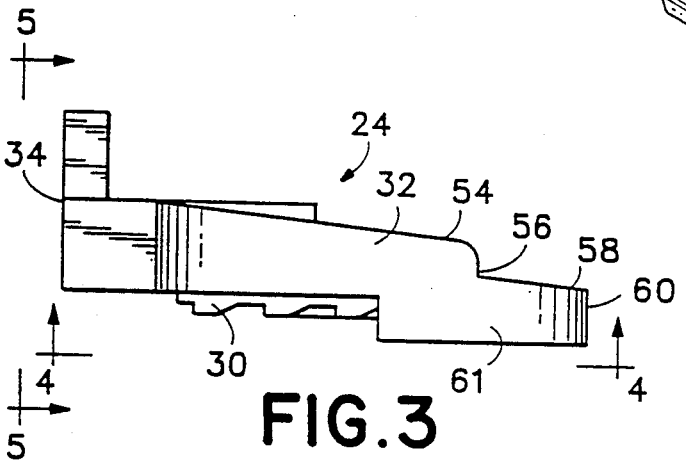
FIG. 3 is a still further enlarged top view of the invented clutch, taken along line 3—3 in FIG. 2.
Figure 4:
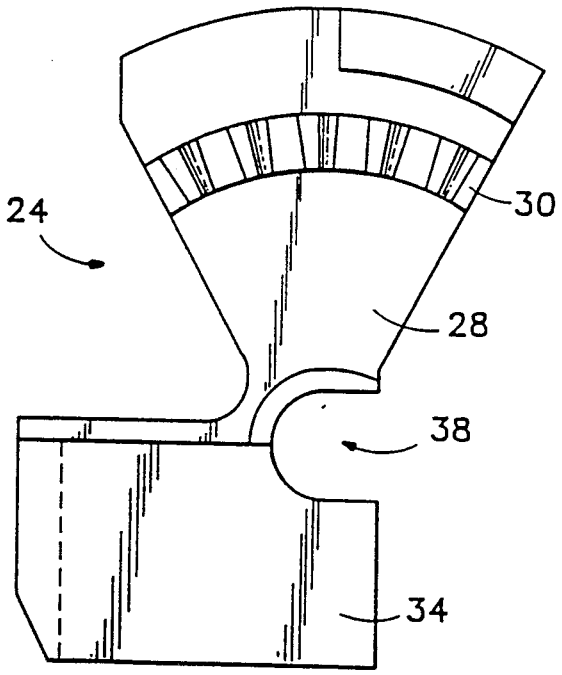
FIG. 4 is a side view, on the same scale as FIG. 3, of the invented clutch taken along line 4—4 in FIG. 3.
Figure 5:
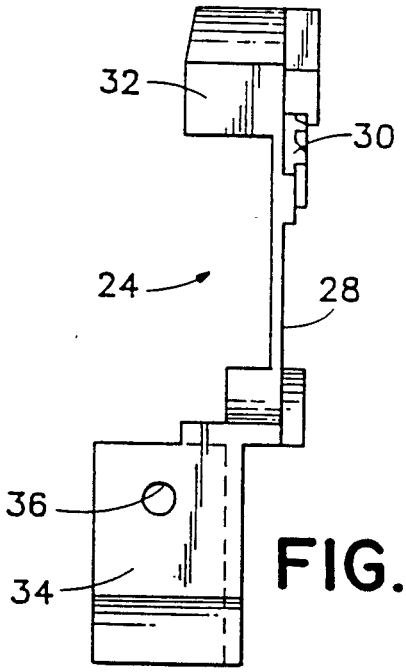
FIG. 5 is a front view of the invented clutch, on the same scale as FIGS. 3 and 4, taken along line 5—5 in FIG. 3.

The invented carriage-actuated clutch may be employed in any printer capable of performing different tasks. One such printer is shown in FIG. 1 at 10. Printer 10 includes a housing 12, a paper input tray 14, a paper output tray 16 (shown partially cut away) and a spring-biased plate 18 for directing paper into the printer. Printer 10 may also include other standard elements well known in the art.

Printer 10 further includes drive roller 20 (shown in dashed lines in FIG. 1). Rollers 20 are connected to a drive shaft 22 (also shown in dashed lines in FIG. 1) that is motor driven. The motor is not shown in FIG. 1 for simplicity and because any standard motor and coupling may be used to rotate drive shaft 22. When paper contacts rollers 20 and when the rollers are rotated, paper is fed into the printer 10. The paper is directed around rollers 20 and ejected into output tray 16. An example of a printer using similar drive rollers to feed paper is disclosed in U.S. Pat. No. 4,728,963 to Rasmussen, et al.

FIG. 1 also shows, in dashed lines, the invented carriage-actuated clutch 24 in its environment. Clutch 24 is rotatably mounted to shaft 22 and attached to a pivot 26. Clutch 24 is shown in FIG. 1 to illustrate one possible location within a printer and pivot 26 is shown to illustrate its general relationship with the clutch. Other elements that interact with the clutch are shown in FIG. 6 (to be discussed shortly) but not in FIG. 1, for simiplicity.

Clutch 24 is shown more specifically in FIGS. 2–5 and is typically machine or molded from plastic. The clutch includes a flexible portion 28, a gripping surface, such as teeth 30, and adjustment means such as protrusion 32. Clutch 24 may be mounted to pivot 26 by bracket 34. A screw may be inserted through aperture 36 to securely engage clutch 24 to pivot 26. Additionally, clutch 24 may be rotatably mounted to a drive shaft by inserting the shaft in notch 38.

In operation, clutch 24 will be attached to pivot 26 and rotatably mounted to drive shaft 22. When the clutch is to be engaged, a force may be directed against protrusion 32 in such a way that the clutch flexes in the flexible portion 28. When the clutch flexes, teeth 30 engage a gear that causes the clutch to rotate. The operation of clutch 24 will be better understood by reviewing FIGS. 6–12.

Figure 6:
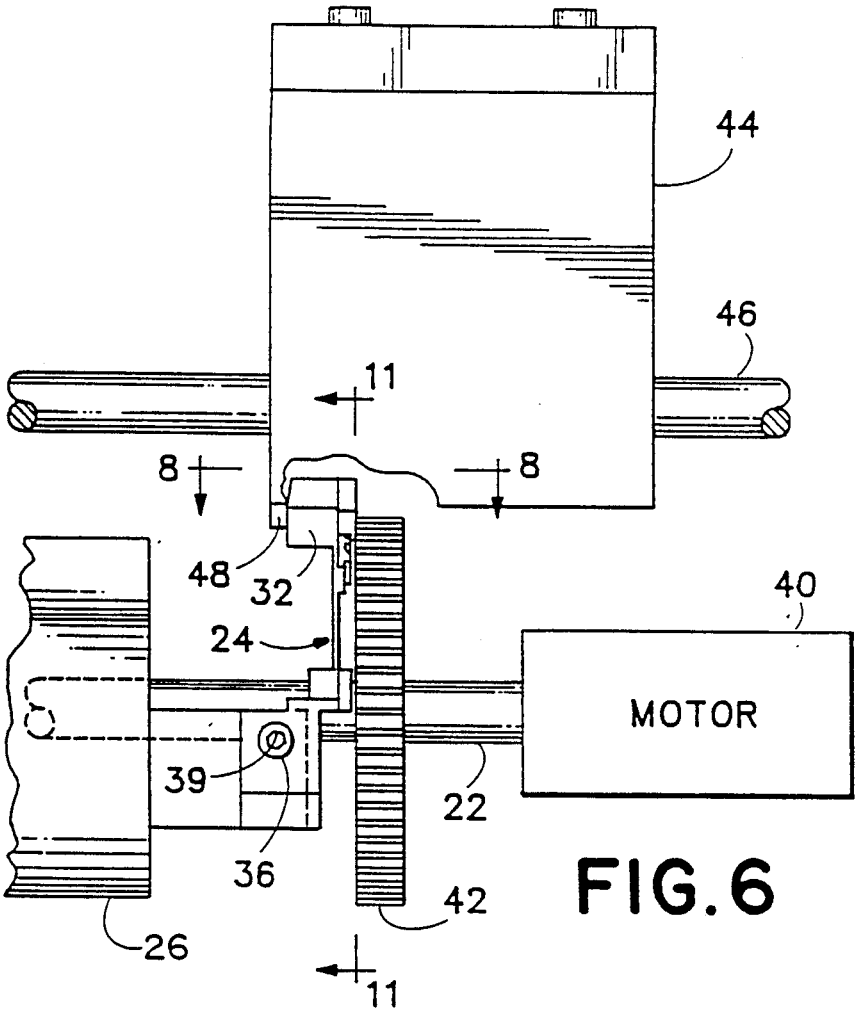
FIG. 6 is a simplfied environmental view, on about the same scale as FIG. 2, showing a printhead carriage, the invented clutch mounted to a pivot, and a motor-driven gear capable of engaging the clutch.

FIG. 6 shows clutch 24 in its environment. Clutch 24 is attached to pivot 26 by screw 39 extending through aperture 36 in bracket 34, and rotatably mounted to drive shaft 22. Drive shaft 22 is driven by motor 40. A driven element, or gear, 42 is also shown mounted to shaft 22. Gear 42 and motor 40 are contained within printer 10 but not depicted in FIG. 1. When motor 40 rotates shaft 22, gear 42 and rollers 20 are also rotated. However, when clutch 24 is in its unflexed position, as shown in FIG. 6, gear 42 rotates without engaging clutch 24, and the clutch does not move. Clutch 24 only engages gear 42 when a force causes it to shift laterally or flex toward gear 42. As shown in FIG. 6, a force substantially paralleling clutch 24's rotational axis around shaft 22 may be supplied by a printhead carriage 44 mounted to reciprocate on rod 46. Carriage 44 herein includes printing means (not shown) having a printhead, whereby images are printed on a sheet of print media, with the carriage being motor driven and computer controlled.

Figure 7:
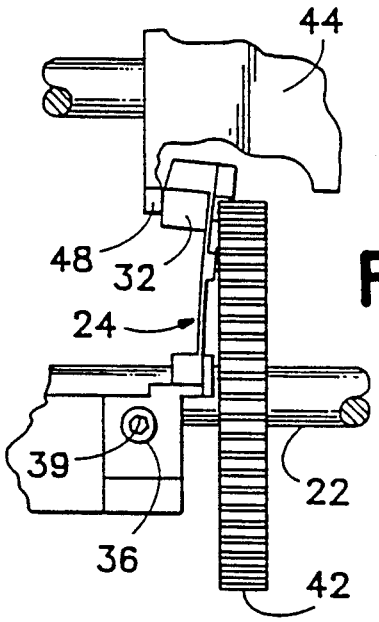
FIG. 7, on about the same scale as FIG. 6, shows the clutch of FIG. 6 flexed and engaged with the motor-driven gear.

In FIG. 6, carriage 44 is shown cut away so that a foot 48 on the carriage is seen engaging protrusion 32 on clutch 24. It is the maintained position of foot 48 against protrusion 32 that forces clutch 24 to flex. FIG. 7 is a front view showing clutch 24 flexed and engaged with gear 42.

Figure 8:
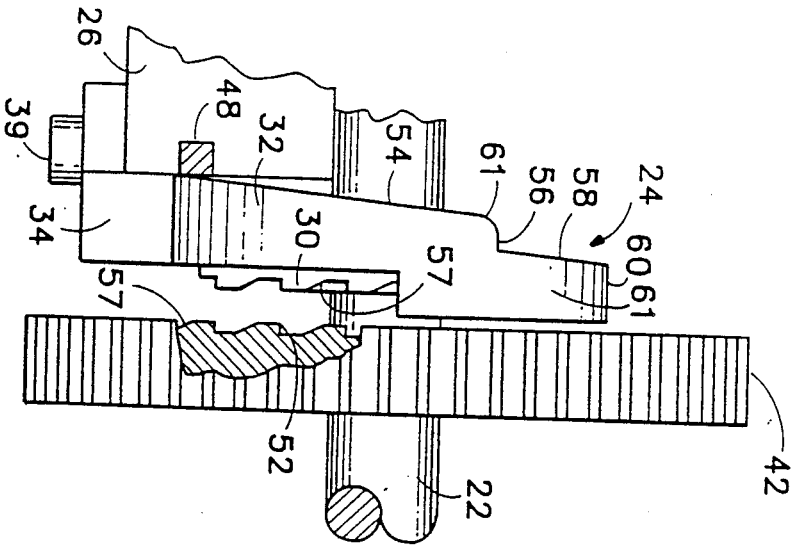
FIG. 8 is an enlarged top view of the invented clutch taken along line 8—8 in FIG. 6.

FIG. 8 also shows clutch in its environment. More specifically, FIG. 8 is a top view of clutch 24 and gear 42 taken along line 8—8 in FIG. 6, showing foot 48 touching protrusion 32. Gear 42 is broken away to show a gripping surface such as teeth 52 capable of engaging teeth 30.

Figure 9:
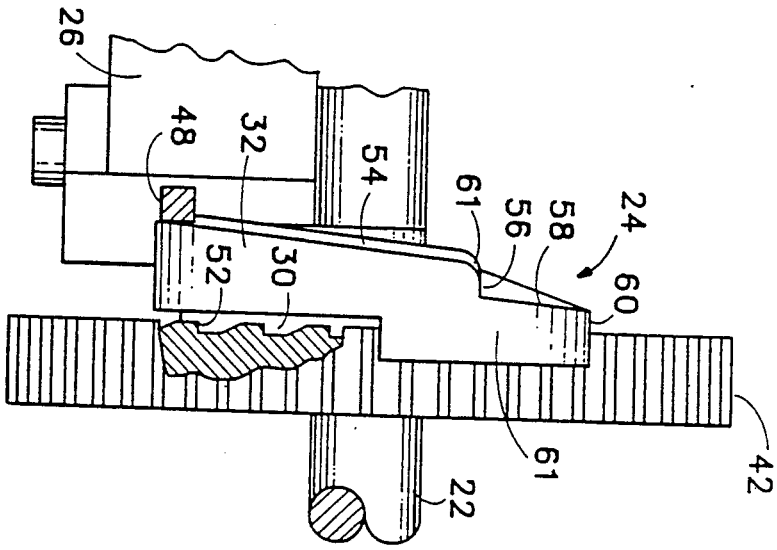
FIG. 9 is similar to FIG. 8, except that it shows the invented clutch flexed and engaging the motor-driven gear.

To engage clutch 24 with gear 42, carriage 44 is moved so that foot 48 pushes against protrusion 32, as shown in FIG. 9. The resulting force causes clutch 24 to flex at 28, thus causing teeth 30 to engage teeth 52. When engaged, clutch 24 is rotated by rotating gear 42.

Figure 10:
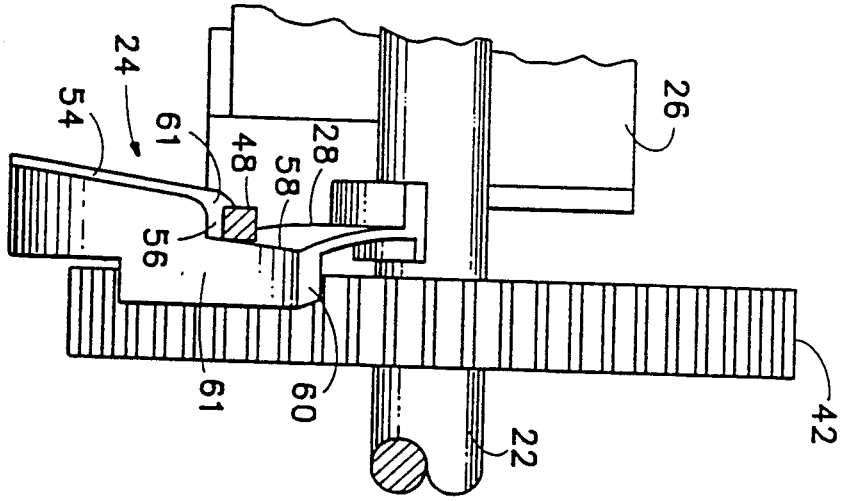
FIG. 10 is similar to FIG. 8, except that it shows the invented clutch flexed, engaged with the motor-driven gear, and rotated.

FIG. 10 shows the clutch rotated a predetermined distance. Additionally, FIG. 10 shows clutch 24 flexed at flexible portion 28.

As seen in FIGS. 2, 3, 8, 9 and 10, protrusion 32 has a tapered surface 54. When foot 48 pushes against protrusion 32 it causes clutch 24 to engage with gear 42. Thereafter the clutch is rotated, and foot 48 slides along surface 54. When clutch 24 has been rotated a predetermined distance, foot 48 slides off surface 54 and rests on ledge 56. The construction of clutch 24 is such that when foot 48 rests on ledge on 56, clutch 24 flexes away from gear 42 because foot 48 no longer pushes against protrusion 32. Accordingly, at this point, gear 42 and clutch 24 are not engaged.

In some instances, clutch 24 may not be able to flex away from gear 42 because of the friction between teeth 30 and 52 or because the clutch does not have enough spring force to cause it to return to its normal position. Accordingly, the teeth have tapered surfaces 57. When foot 48 rests on ledge 56 and gear 42 is rotated, tapered surfaces 57 push teeth 30 and 52 apart.

Extending beyond ledge 56 is a second surface 58. Clutch 24 may again engage gear 42 if carriage 44 is moved further toward gear 42 so that foot 48 pushes on surface 58. By so doing, the clutch may again engage gear 42 and rotate a certain distance until foot 48 slips off surface 58 onto ledge 60. As seen in FIGS. 2, 3, 8, 9 and 10, ledge 60 is an edge of region 61. Region 61 prevents foot 48 from accidentally slipping behind ledge 60 and becoming caught. Additionally, protrusion 32, surfaces 54 and 58, and ledges 56 and 60 give clutch 32 a means to adjust the force applied by foot 48. This ability to rotate clutch 24 through predetermined distances, and to adjust the force applied by foot 48, allows different printer tasks to be performed.

Figure 11:
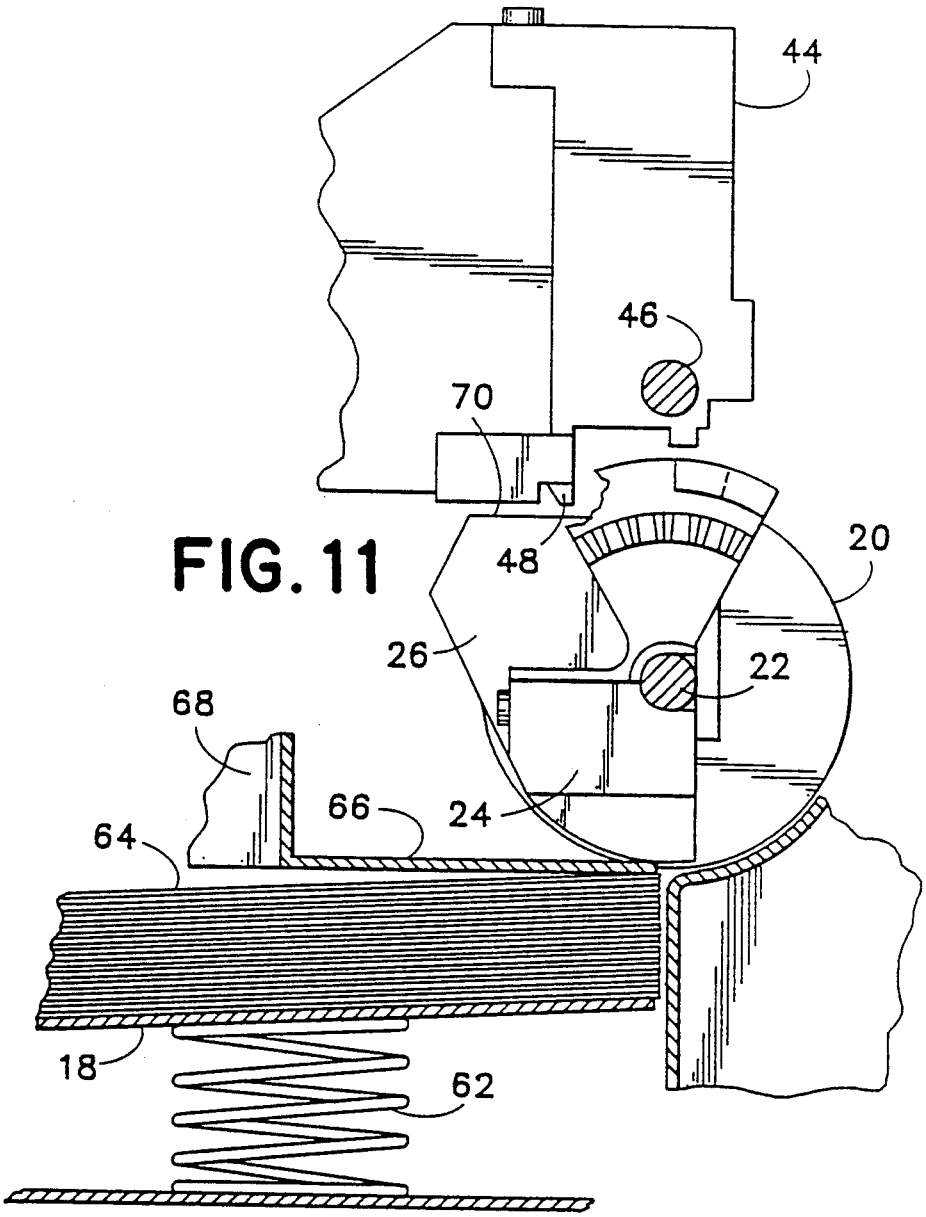
FIG. 11 is a simplified environmental view of the invented clutch taken along line 11—11 in FIG. 6, and also showing the invented paper-feed mechanism.

FIG. 11 shows clutch 24 mounted to pivot 26 and shaft 22. The relationship between clutch 24, drive rollers 20 and carriage 44 are also shown. Clutch 24 is shown cut away so that foot 48 is visible. FIG. 11 shows clutch 24 in its initial unrotated position.

Figure 12:
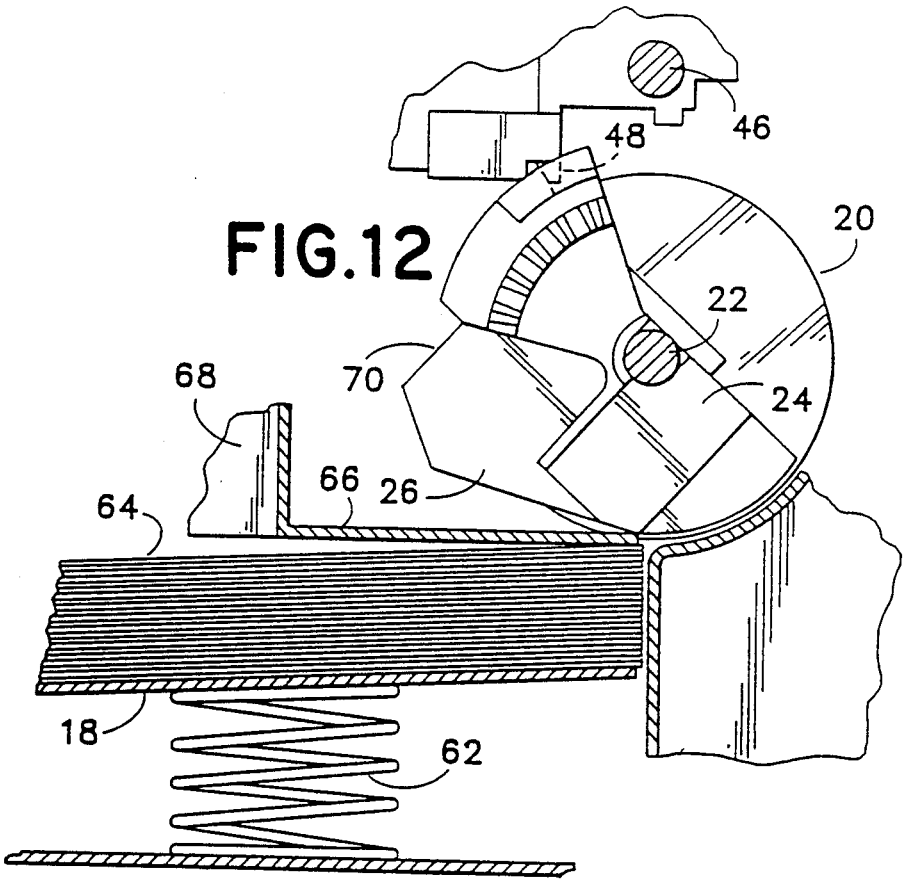
FIG. 12 is a view similar to FIG. 11, except that it shows the invented clutch in a rotated position.

FIG. 12 is similar to FIG. 11 in that it shows clutch 24 mounted to pivot 26 and shaft 22. However, FIG. 12 shows clutch 24 rotated so that foot 48 rests on ledge 56. This position may be referred to as the first rotated position.

Figure 13:
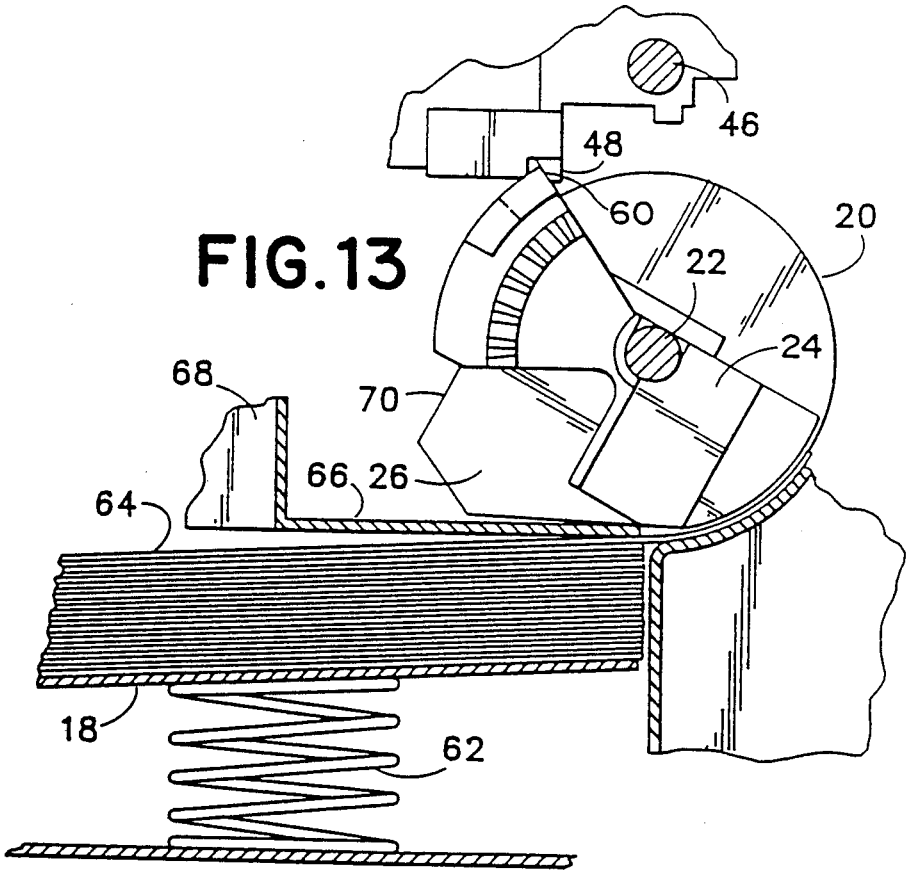
FIG. 13 is similar to FIG. 11, except that it shows the invented clutch in a rotated position, and the paper-feed mechanism ready to pick up a sheet of paper.

FIG. 13 shows clutch 24 rotated so that foot 48 rests on ledge 60. This position may be referred to as the second rotated position.

In the preferred embodiment, clutch 24 rotates counterclockwise as viewed in FIGS. 11–13. Clutch 24 is also spring-biased so that when carriage 44 is retracted and foot 48 no longer contacts the clutch, the clutch rotates clockwise back to its initial position, as shown in FIG. 11. Carriage 44 and foot 48 may also be used to control the speed and degree that clutch 24 rotates back to its initial position. This is done by moving carriage 44 away from clutch 24 slowly while foot 48 maintains contact with protrusion 32 so that foot 48 slides along surfaces 54 and 58. As seen in FIGS. 8–10, surfaces 54 and 58 are tapered to facilitate the controlled backward rotation of clutch 24 and ledge 56 has a curved corner 61 to allow foot 48 to slide from ledge 56 to surface 54.

One of the tasks that may be performed by actuation of the clutch is to feed paper into the printer. FIGS. 11–13 also depict a paper-feed mechanism that may be used with the invented clutch.

The paper-feed mechanism includes plate 18 and a spring 62. Spring 62 biases plate 18 upward toward rollers 20. Paper 64 that is to be fed into the printer is stacked on plate 18. When drive rollers 20 contact the top sheet of paper 64 they feed the sheet into the printer.

Figure 14:
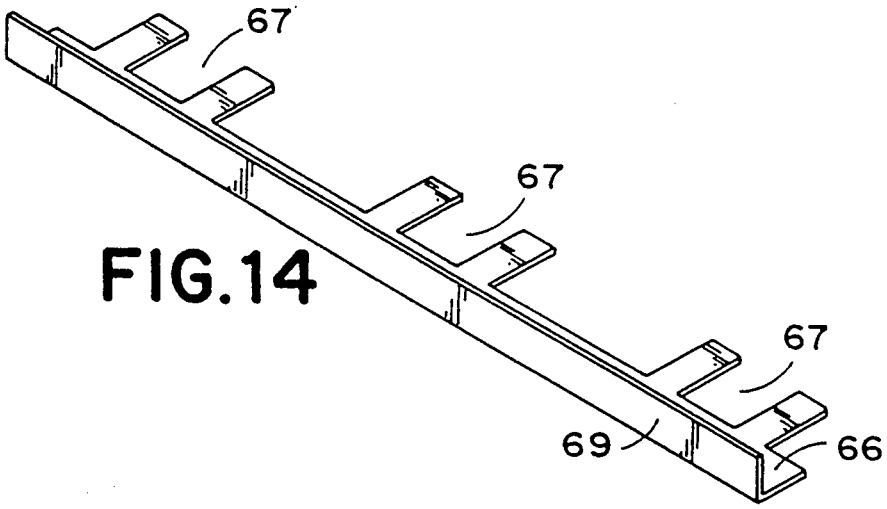
FIG. 14 is a reduced-scale drawing showing the partition used in the paper-feed mechanism.

To prevent rollers 20 from continually contacting and feeding paper into printer 10, a means to regulate the contact is needed. To accomplish this, a partition 66 is positioned between rollers 20 and paper stack 64 to prevent the rollers from contacting the paper until desired. As shown in FIG. 14, partition 66 includes apertures 67 to allow rollers 20 to extend through and contact the paper when desired. Partition 66 may be mounted to printer chassis 68 or to a paper collection tray, such as tray 16, along edge 69.

As shown in FIG. 11, when clutch 24 is in its initial position, pivot 26 contacts partition 66, which in turn contacts paper 64 and holds it away from rollers 20. As shown in FIG. 13, when clutch 24 is actuated and rotated, pivot 26 allows partition 66, paper 64, and plate 18 to rise. The cam-like shape of pivot 26 is such that when it is rotated a certain amount, it no longer holds partition 66 away from rollers 20, but allows spring 62 to push plate 18 and paper 64 up toward rollers 20. Rollers 20 then extend through apertures 67 in partition 66, contact the top sheet of paper 64 and feed it into the printer. In FIG. 13 the top sheet of paper 64 is shown partially around rollers 20. Thereafter, allowing clutch 24 to return to its initial position causes pivot 26 to prevent rollers 20 from contacting paper 64. In this manner, clutch 24 may actuate a printer's paper-feed mechanism.

Alternately, any means capable of regulating contact with paper 64 and rollers 20 may be used in the paper-feed mechaism. For example, pivot 26 might simply hold paper 64 a sufficient distance away from rollers 20 by directly pressing against plate 18.

Another task that may be controlled by clutch 24 involves the upper surface 70 of pivot 26 when surface 70 functions as a paper-supporting surface. As disclosed in U.S. Pat. No. 4,728,963, a printer may feed paper around rollers 20 and eject that paper into a paper collection tray, such as tray 16 shown in FIG. 1. If such a system is used in an ink jet printer, the ink needs to dry on the sheets of paper before they are stacked on top of each other. To accomplish this, the most recently printed sheet is held above the stack of previously printed sheets, and supported in part by a surface, such as surface 70 on pivot 26. When the support surface is removed, the paper is free to fall into the stack of previously printed sheets. Thus, another task that may be actuated by the invented clutch is to eject paper out from a printer by causing supporting surface 70 to rotate and thereby allow a printed sheet to fall onto a stack of previously printed sheets.

In printer 10, paper is ejected when clutch 24 is in its first rotated position, as shown in FIG. 12. In that position, surface 70 no longer supports a sheet of paper. Further rotating clutch 24 to its second rotated position, as shown in FIG. 13, causes printer 10 to pick up the next sheet of paper to be fed into the printer. Thus, the invented clutch allows printer 10 to perform different tasks without requiring multiple gear trains or multiplexer gears. Because of its function, clutch 24 may also be referred to as control means, or actuation mechanism, for causing the printer to perform different tasks.

INDUSTRIAL APPLICABILITY

Printer carriages typically are driven back and forth as the printer prints. The invented carriage-actuated clutch uses the motion of the carriage to trigger different tasks, and therefore is applicable to any printer capable of performing different tasks such as picking up and ejecting paper. While the best mode and preferred embodiment of the invention have been described, variations may be made without departing from the scope of the invention.

What is claimed is:

1. A printer capable of performing different tasks during a print cycle, comprising:
   a motor-driven gear; and
   a rotatable clutch which is subjected to a force substantially paralleling its rotational axis during each print cycle of the printer, said clutch selectively causing the printer to perform plural different tasks in stages by selectively engaging said gear during application of such force.

2. A printer capable of performing different tasks comprising:
   printing means for printing images on print media including a printhead carriage; and
   control means operatively associated with said printing means for selectively causing the printer to perform plural different tasks in stages,
   wherein said control means is actuated by the position of said carriage and triggers the performance of such tasks because of a maintained position of said carriage.

3. The printer of claim 2, wherein said control means includes a driven element and a clutch engageable by said carriage, and where said clutch engages said element under circumstances of said carriage engaging said clutch.

4. The printer of claim 2 which further includes a media collection tray and paper ejection means for dispensing such media into said tray after printing, and one of the tasks selectively performed by operation of said control means, by virtue of an operative connection existing between said control means and said paper ejection means, involves actuation of said paper ejection means.

5. The printer of claim 2 which further includes drive means for introducing such media into the printer including a drive roller, and paper feed means for bringing such media into contact with said roller, and one of the tasks selectively performed by operation of said control means, by virtue of an operative connection existing between said control means and said paper feed means, involves actuation of said paper feed means.

6. A printer comprising:

a drive motor;

a printhead carriage reciprocally shiftable laterally between limit positions, and actuation mechanism operatively interposed said motor and said carriage including a laterally shiftable element engageable by said carriage during shifting of the same toward one of its said limit positions, operable upon such engagement to effect in stages plural selected print-media-handling activities performed under the influence of said drive motor.

7. A printer capable of performing different tasks comprising:

printing means for printing images on print media including a printhead carriage; and control means including a driven element and a clutch engageable by said carriage, operatively associated with said printing means for selectively causing the printer to perform different tasks, wherein said control means is actuated by the position of said carriage and triggers the performance of such tasks because of a maintained position of said carriage, with such triggering resulting from said clutch engaging said element under circumstances of said carriage engaging said clutch, and wherein further, engagement between said carriage and said clutch takes the form of pushing of the latter by the former, with said clutch including a flexible portion that flexes when said carriage pushes against the clutch, a gripping surface on said flexible portion for engaging said driven element, and adjustment means to regulate the degree that said carriage pushes against the clutch.

8. The printer of claim 7, wherein said adjustment means includes a protrusion on said flexible portion that contacts said carriage when the carriage pushes against the clutch, said protrusion extending from said flexible portion a predetermined distance at one point and extending a lesser predetermined distance at a second point.

* * * * *